United States Patent [19]

Codos

[11] Patent Number: 4,716,845

[45] Date of Patent: Jan. 5, 1988

[54] SEWING MACHINE HAVING ROTATABLE AND AXIALLY MOVABLE FRAME

[75] Inventor: Richard N. Codos, Warren, N.J.

[73] Assignee: Pathe Computer Control Systems, Inc., Irvington, N.J.

[21] Appl. No.: 881,846

[22] Filed: Jul. 3, 1986

[51] Int. Cl.[4] ..... D05B 11/00

[52] U.S. Cl. ..... 112/118

[58] Field of Search ..... 112/118, 117, 119

[56] References Cited

U.S. PATENT DOCUMENTS

| | | | |
|---|---|---|---|
| 351,468 | 10/1886 | Schultz | 112/118 X |
| 447,794 | 3/1891 | Schultz et al. | 112/118 X |
| 448,253 | 3/1891 | Palmer | 112/118 X |
| 456,726 | 7/1891 | Koch | 112/118 |
| 467,138 | 1/1892 | Hadley | 112/118 X |
| 1,937,491 | 11/1933 | May | 112/117 |
| 1,946,868 | 2/1934 | May | 112/118 |
| 2,377,951 | 6/1945 | May | 112/117 |
| 3,180,293 | 4/1965 | Cash | 112/118 |
| 3,677,207 | 7/1972 | Iwase | 112/118 |

*Primary Examiner*—H. Hampton Hunter
*Attorney, Agent, or Firm*—David A. Jackson

[57] ABSTRACT

A quilting machine includes a base having three bridges; a sewing head secured to the upper bridge; a cylindrically shaped frame slidably and rotatably mounted on the lower two bridges, the frame including first and second end assemblies spaced from each other on the lower bridges, each having a support casting slidably mounted on the base and a ring rotatably mounted on a support casting, each ring including circumferential gear teeth, gears meshing with the gear teeth and extending from the support castings for supporting the rings, a plurality of first and second telescoping rods secured to the first and second end assemblies, at least one first telescoping rod screw-threadedly receiving a second telescoping rod, and at least one first and second telescoping rod rotatably fixed and axially movable with respect to each other, a gear secured to each of the latter in meshing engagement with the gear teeth of the respective rings; a mechanism for rotating the axially movable and rotatably fixed first and second telescoping rods to rotate the rings; an elongation mechanism for rotating one of the first and second screw-threaded telescoping rods to change the length of the frame; a rack and pinion assembly for axially moving the frame along the lower bridges of the base; clamps secured to the outer circumference of each ring for clamping fabric to the frame; and two piston-cylinder assemblies for closing or opening the clamps during rotation of the rings.

17 Claims, 15 Drawing Figures

SEWING MACHINE HAVING ROTATABLE AND AXIALLY MOVABLE FRAME

BACKGROUND OF THE INVENTION

This invention relates generally to sewing machines for sewing quilts, comforters and analogous articles and, more particularly, is directed to a sewing machine having a rotatable and axially movable cylindrically-shaped frame for holding the fabric.

Because of the large size of quilts, comforters and the like, it is difficult to sew patterns thereon. Further, apparatus for sewing the same must occupy a substantial amount of space because of the large size of quilts and comforters, thereby rendering such apparatus inefficient and space consuming.

In order to overcome some of the disadvantages of conventional apparatus, a sewing machine for sewing quilts, comforters and the like has been designed with a substantially cylindrical frame which is rotatable and axially movable on a base and which can expand or contract its lengthwise dimension. Examples of such sewing machines are found in U.S. Pat. Nos. 351,468; 447,794; 448,253; 456,726; 467,138; 1,937,491; 1,946,868; and 2,377,951.

For example, U.S. Pat. No. 1,937,491 generally discloses a rotatable quilting machine having a substantially cylindrical frame axially movable along a base by pulleys which ride upon a central sleeve of the base and by pulleys which cooperate with an upper T-rail of the base. The frame is manually moved along the base by the operator.

The length of the frame is also manually adjustable by adjustable collars, and the frame is rotatably mounted upon the aforementioned central sleeve and manually rotated by raising or lowering of a bar by the operator.

U.S. Pat. No. 1,946,868 discloses a similar arrangement. However, a first rod extends from one end and includes internal screw threads and a second rod extends from the opposite end and is screw-threadedly received within the first rod. A crank handle rotates one of the rods to move the outer rings of the cylindrical frame closer together or further apart.

U.S. Pat. No. 2,377,951 expands on the previous Patent by providing a plurality of such screw-threaded telescoping members. In addition, drive sprockets are provided at the ends of the screw-threaded members at each end of the frame, and a chain passes over the drive sprockets and various idler sprockets. By means of a wrench which can be placed on a non-circular portion of one of the screw-threaded shafts for rotating the same, all of the screw-threaded shafts at the same end of the frame are rotated by means of the chain drive.

Various other ones of the Patents, such as U.S. Pat. No. 467,138 discloses a rotatable drive mechanism in which the outer rings are provided with gear teeth. Through suitable gearing and a manual crank wheel, the frame can be rotated about a central shaft. See also U.S. Pat. No. 448,253.

As to the axial movement of the frame, U.S. Pat. No. 456,726 discloses the use of two cams which coact with projections to provide side-to-side movement of the carriage in a specific pattern.

With all of the above patents, however, the arrangements that are provided for rotating and axially moving the frame are relatively complicated and consume unnecessary space. In addition, there are no automatic means, such as motor means or the like, for controlling rotation, axial movement and elongation of the frame.

In the above discussed patents, the fabric of the quilt or comforter is secured at opposite ends about the substantially cylindrical frame by means of clamping fingers or the like which are manually set. See, for example, U.S. Pat. No. 1,937,491. However, the securement of the fabric to the frame is time consuming and tedious, and therefore inefficient.

OBJECTS AND SUMMARY OF THE INVENTION

Accordingly, it is an object of the present invention to provide a sewing machine for quilts, comforters and the like that avoids the aforementioned difficulties.

It is another object of the present invention to provide a sewing machine for quilts, comforters and the like having a substantially cylindrical frame, including respective motors for axially and rotatably driving the frame with respect to a base and for changing the length of the frame on the base.

It is still another object of the present invention to provide a sewing machine for quilts, comforters and the like having a substantially cylindrical frame axially movable along a base by means of a rack and pinion arrangement which is driven by a motor.

It is yet another object of the present invention to provide a sewing machine for quilts, comforters and the like having a substantially cylindrical frame about which the fabric is secured and a clamping assembly which automatically clamps the fabric on the frame.

In accordance with a first aspect of the present invention, a quilting machine includes:

(a) a base;

(b) a substantially cylindrically shaped frame slidably and rotatably mounted on the base, the frame including:

(i) a first end assembly;

(ii) a second end assembly;

(iii) each end assembly having a support member slidably mounted on the base and a ring rotatably mounted on the respective support member, each ring having a plurality of gear teeth spaced therearound;

(iv) the first and second end assemblies spaced from each other on the base;

(v) a plurality of first telescoping rods secured to the first end assembly and extending toward the second end assembly;

(vi) a plurality of second telescoping rods secured to the second end assembly and extending toward the first end assembly;

(vii) each first telescoping rod telescopically receiving a respective second telescoping rod;

(viii) at least one first telescoping rod screw-threadedly receiving at least one respective second telescoping rod;

(ix) at least one first and second telescoping rod rotatably fixed and axially movable with respect to each other; and (x) a gear on each of said first and second rotatably fixed and axially movable telescoping rods in mating engagement with said gear teeth of said rings;

(c) rotation means for rotating the rings with respect to the support members and including first rod rotation means for rotating said first and second rotatably fixed and axially movable telescoping rods;

(d) elongation means for changing the length of the frame, including second rod rotation means for rotating at least one screw-threaded rod; and (e) frame moving means for axially moving the frame along the base, the frame moving means including a rack having gear teeth mounted on the base, a gear rotatably mounted on the frame in meshing engagement with the teeth of the rack, and control means for controlling rotation of the gear to move the frame along the base.

In accordance with another aspect of the present invention, a quilting machine includes:

(a) a base;

(b) a substantially cylindrically shaped frame slidably and rotatably mounted on the base, the frame including:

(i) a first end assembly;

(ii) a second end assembly;

(iii) each end assembly having a support member slidably mounted on the base and a ring rotatably mounted on the respective support member, each ring having a plurality of gear teeth spaced therearound;

(iv) the first and second end assemblies spaced from each other on the base;

(v) a plurality of first telescoping rods secured to the first end assembly and extending toward the second end assembly;

(vi) a plurality of second telescoping rods secured to the second end assembly and extending toward the first end assembly;

(vii) each first telescoping rod telescopically receiving a respective second telescoping rod;

(viii) at least one first telescoping rod screw-threadedly receiving at least one respective second telescoping rod;

(ix) at least one first and second telescoping rod rotatably fixed and axially movable with respect to each other; and (x) a gear on each of the first and second rotatably fixed and axially movable telescoping rods in mating engagement with said gear teeth of said rings;

(c) rotation means for rotating the rings with respect to the support members and including first rod rotation means for rotating the first and second rotatably fixed and axially movable telescoping rods;

(d) elongation means for changing the length of the frame, including second rod rotation means for rotating at least one screw-threaded rod;

(e) frame moving means for axially moving the frame along the base;

(f) a plurality of clamp means secured to the outer circumference of each ring for clamping fabric to the frame; and (g) clamp actuation means for controlling the plurality of clamp means to selectively clamp or unclamp the fabric with respect to the rings during rotation of the rings.

In accordance with still another aspect of the present invention, a quilting machine includes:

(a) a base;

(b) a substantially cylindrically shaped frame slidably and rotatably mounted on the base, the frame including:

(i) a first end assembly., (ii) a second end assembly;

(iii) each end assembly having a support member slidably mounted on the base and a ring rotatably mounted on the respective support member, each ring having a plurality of gear teeth spaced therearound;

(iv) the first and second end assemblies spaced from each other on the base;

(v) a plurality of first telescoping rods secured to the first end assembly and extending toward the second end assembly;

(vi) a plurality of second telescoping rods secured to the second end assembly and extending toward the first end assembly;

(vii) each first telescoping rod telescopically receiving a respective second telescoping rod;

(viii) at least one first telescoping rod screw-threadedly receiving at least one respective second telescoping rod;

(ix) at least one first and second telescoping rod rotatably fixed and axially movable with respect to each other; and (x) a gear on each of the first and second rotatably fixed and axially movable telescoping rods in mating engagement with said gear teeth of said rings;

(c) rotation means for rotating the rings with respect to the support members and including first rod rotation means for rotating the first and second rotatably fixed and axially movable telescoping rods;

(d) elongation means for changing the length of the frame, including second rod rotation means for rotating at least one screw-threaded rod;

(e) frame moving means for axially moving the frame along the base;

(f) flexible frame means having opposite flexible edges and a plurality of clamps spaced along the flexible edges for clamping a fabric therebetween;

(g) a plurality of clamp means secured to the outer circumference of each ring for clamping the flexible frame means to the frame; and (h) clamp actuation means for controlling the plurality of clamp means to selectively clamp or unclamp the flexible frame means with respect to the rings during rotation of the rings.

The above and other objects, features and advantages of the present invention will become readily apparent from the following detailed description thereof which is to read in connection with the accompanying drawings.

DETAILED DESCRIPTION OF THE PREFERRED EMBODIMENTS

Figure 1:
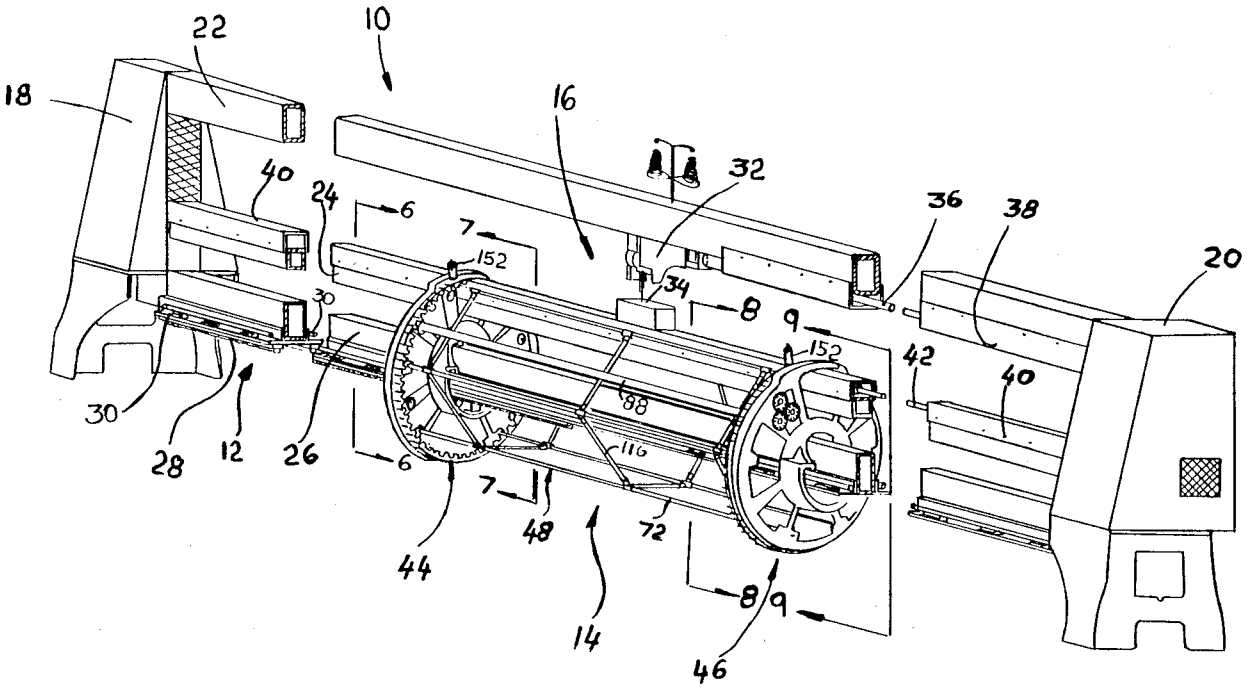
FIG. 1 is a front perspective view of a sewing machine according to the present invention, without the outer covering on the frame.
Figure 2:
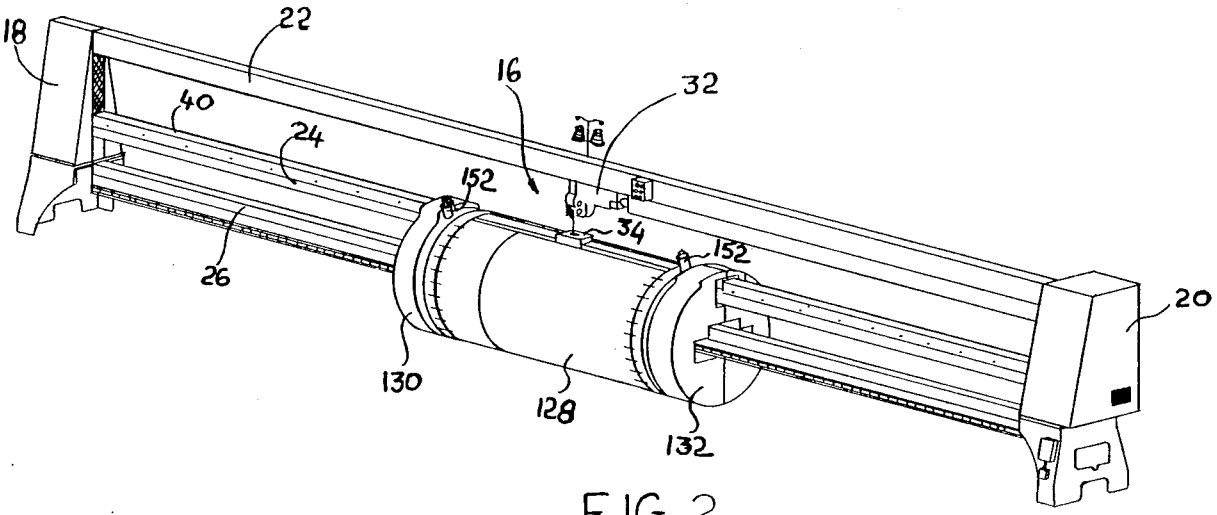
FIG. 2 is a perspective view of the sewing machine of FIG. 1 with the outer covering on the frame.
Figure 5:
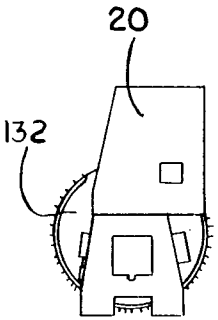
FIG. 5 is an end elevational view of the sewing machine of FIG. 2.
Figure 3:
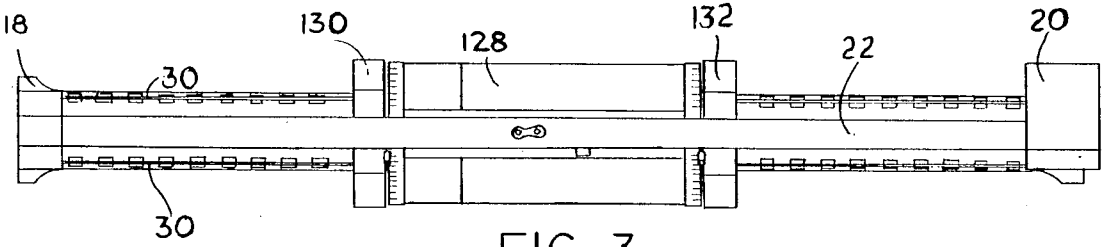
FIG. 3 is a top plan view of the sewing machine of FIG. 2.
Figure 4:
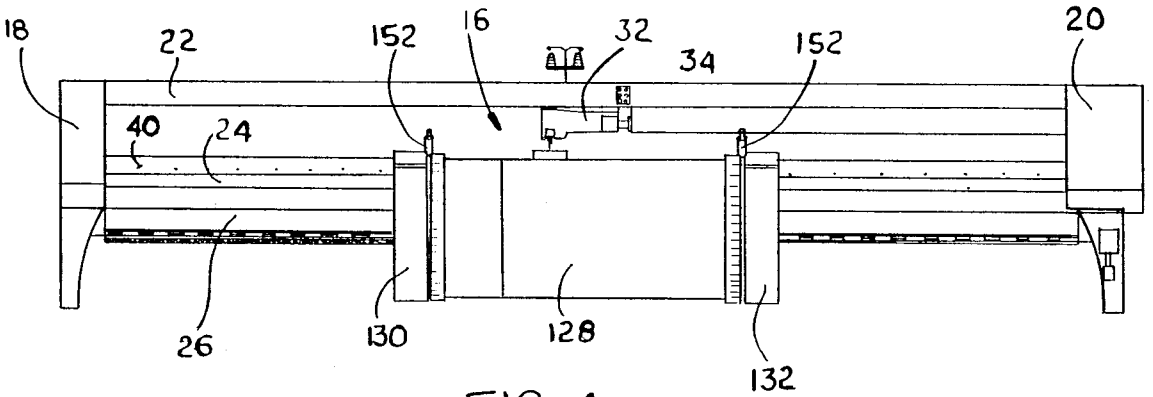
FIG. 4 is a front elevational view of the sewing machine of FIG. 2.

Referring to the drawings in detail, and initially to FIG. 1 thereof, a single needle, computer controlled frame quilting machine 10 according to the present invention generally includes a base 12, a substantially cylindrically shaped frame 14 slidably and rotatably mounted on base 12 and a sewing section 16 mounted on base 12 directly above frame 14.

Specifically, base 12 includes end supports 18 and 20 and an upper horizontal bridge 22, a middle horizontal bridge 24 and a lower horizontal bridge 26, all in substantially vertical alignment, for interconnecting end supports 18 and 20. As shown in the Figures, bridges 22, 24 and 26 may be constructed from beams having a square or rectangular cross-section and which interconnect end supports 18 and 20. As shown in FIGS. 1 and 6–9, base 12 includes L-shaped brackets 28 extending on opposite sides from the lower end of lower bridge 22 and extending outwardly therefrom. A sliding Thomson shaft 30 is secured along the length on the upper surface of the laterally extending leg of each L-shaped bracket 28 for slidably supporting frame 14 thereon, as will be described in greater detail hereinafter.

Sewing machine 16 includes a sewing head 32 secured to the underside of upper bridge 22 and a bobbin 34 secured on top of middle bridge 24 directly under sewing head 32, as is well known in the art. In order to provide control of sewing head 32, a sewing head drive shaft 36 extends from end support 20 into driving engagement with sewing head 32 and is positioned directly beneath upper bridge 22. A U-shaped cover plate 38 is secured to the lower portion of upper bridge 22 so as to define a channel therein through which sewing head drive shaft 36 extends. In like manner, an inverted U-shaped cover plate 40 is secured to the upper portion of middle bridge 24 and defines a channel therein through which a bobbin drive shaft 42 extends from end support 20 into driving engagement with bobbin 34 which is situated on inverted U-shaped cover plate 40. As will be appreciated from the discussion hereinafter, when a fabric is secured to frame 14, the fabric extends over bobbin 34, that is, between the needle of sewing head 32 and bobbin 34 so that a pattern can be sewn thereon. In this regard, bobbin 34 does not extend to a height greater than that of frame 14 to which the fabric is secured.

Frame 14 is generally formed of a first end assembly 44, a second end assembly 46 and transverse rods 48 which interconnect first and second end assemblies 44 and 46. Specifically, first and second end assemblies include support castings 50 and 52, respectively, slidably mounted on Thomson shafts 30 in spaced relation to each other. Support castings 50 and 52 are generally of a circular or ring shaped configuration having a plurality of apertures spaced thereabout so as to define an outer periphery 54 a hub 56 and plurality of spider arms 58 interconnecting hub 56 and outer periphery 54. An inverted T-shaped central opening 60 is provided in hub 56 and defines downwardly facing horizontal shoulders 62 to which Thomson bearings 64 are secured, the latter engaging with Thomson shafts 30 to slidably support castings 50 and 52, and thereby frame 14, on lower bridge 26.

Figure 7:
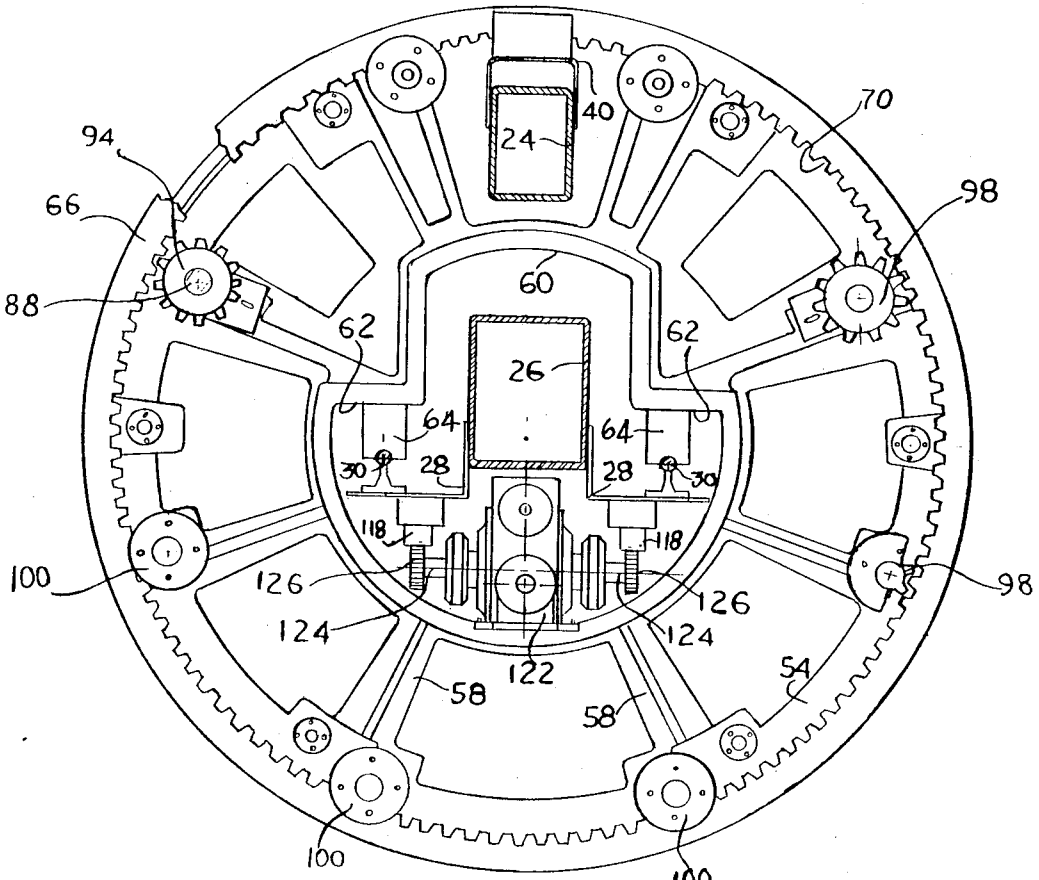
FIG. 7 is a cross-sectional view of the sewing machine of FIG. 1, taken along line 7—7 thereof.
Figure 8:
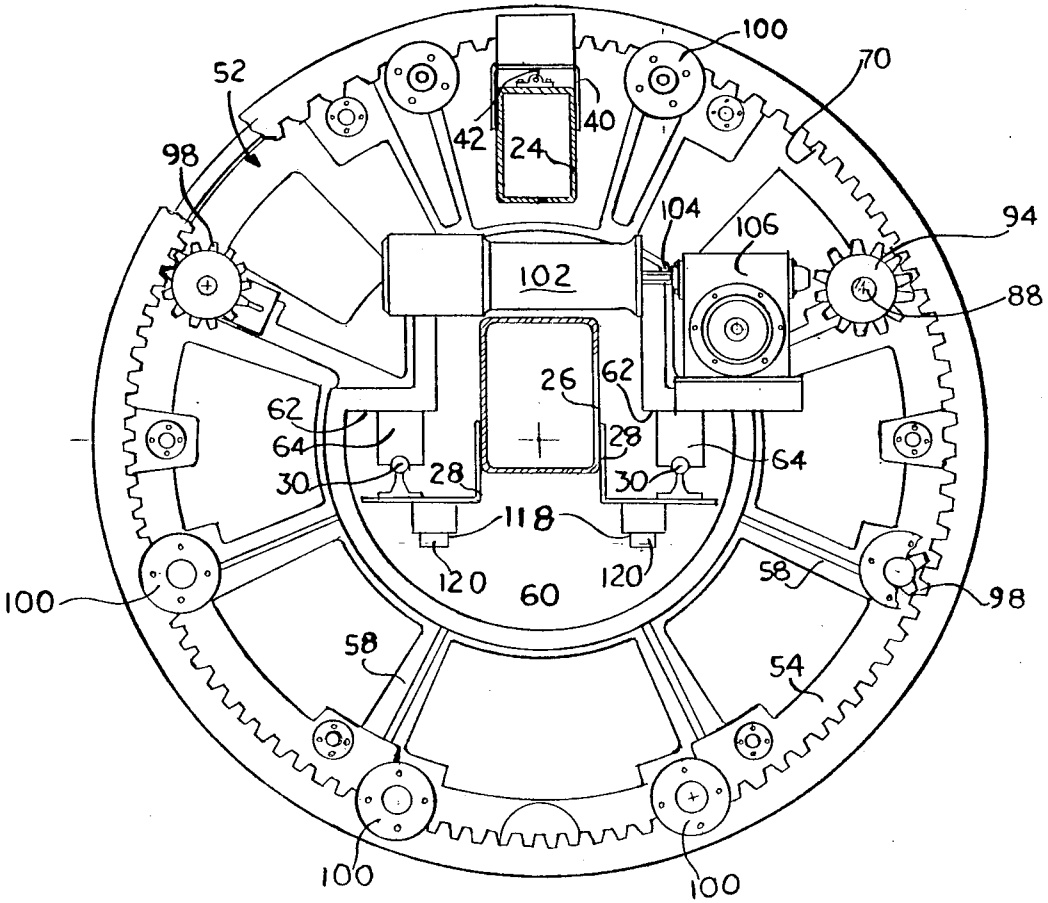
FIG. 8 is a cross-sectional view of the sewing machine of FIG. 1, taken along line 8—8 thereof.
Figure 9:
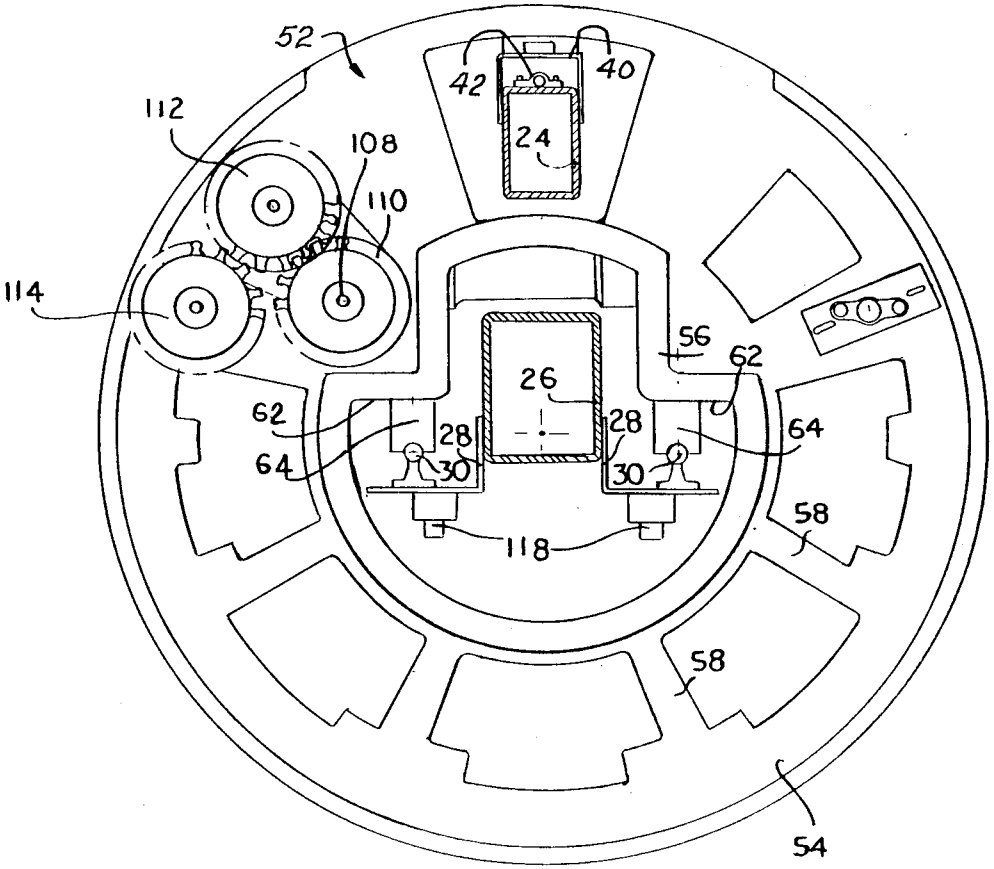
FIG. 9 is a cross-sectional view of the sewing machine of FIG. 1, taken along line 9—9 thereof.

First and second end assemblies 44 and 46 further include inner rings 66 and 68, respectively, which are rotatably mounted to support castings 50 and 52, respectively, as shown in FIGS. 7 and 8. As shown, rings 66 and 68 include gear teeth 70 along the entire inner circumference thereof, by which rings 66 and 68 are supported with respect to the respective castings 50 and 52 and by which frame 14 is rotated, as will be discussed in greater detail hereinafter.

Figure 10:
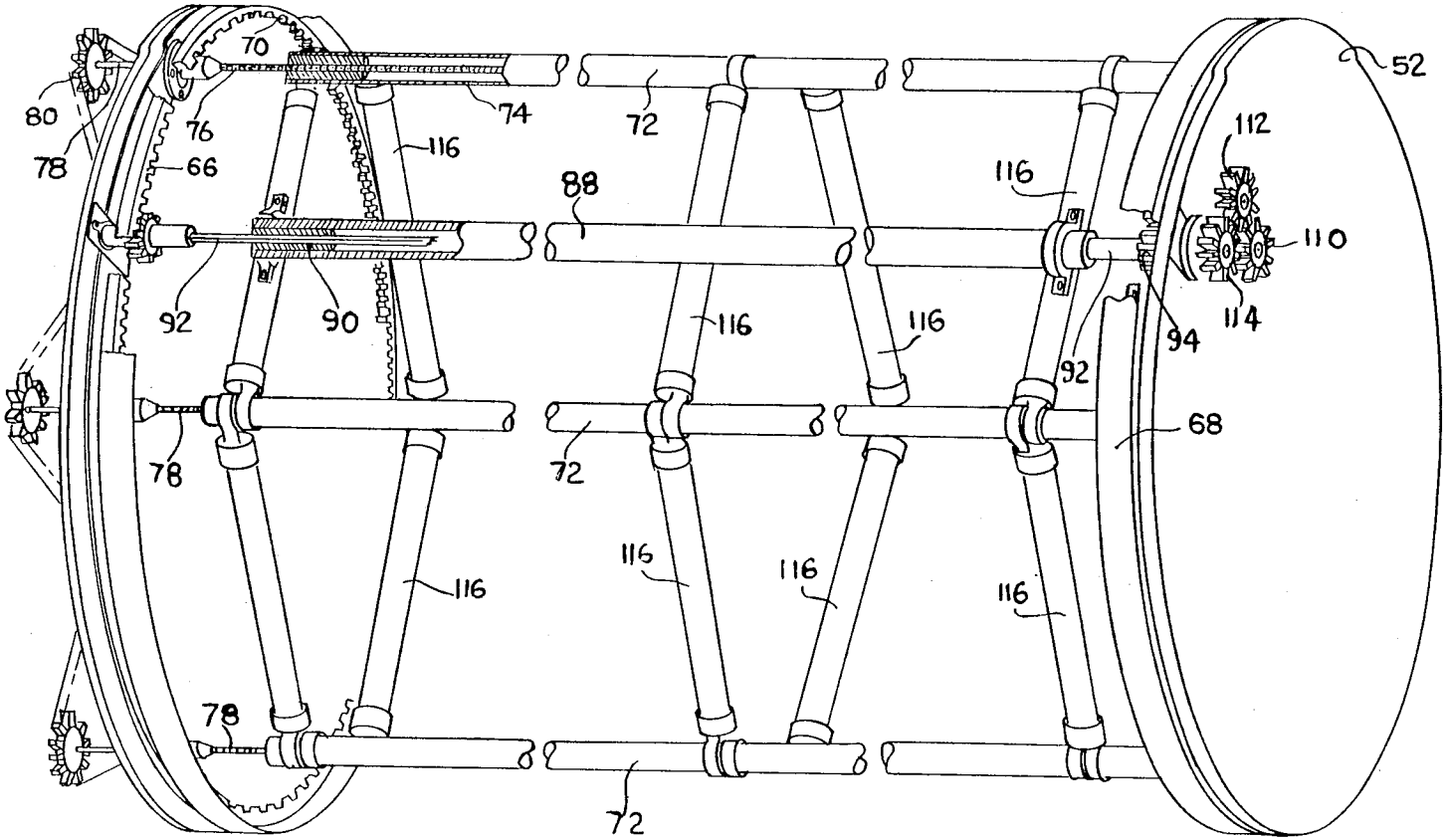
FIG. 10 is an enlarged perspective view of the substantially cylindrical frame of the sewing machine of FIG. 1.

As shown in FIGS. 1 and 10, a plurality of longitudinally extending rods 72 are secured to support casting 52 and extend toward support casting 50, but being spaced slightly from inner ring 66. Rods 72 are hollow, as shown in FIG. 10 and include a threaded bushing 74 at the distal ends thereof. A threaded rod 76 is rotatably secured to casting 50 by any suitable means, such as a bearing or the like, and is screw-threadedly received in bushing 74. Thus, as threaded rod 76 is rotated into or out of threaded bushing 74, first and second end assemblies 44 and 46 move toward or away from each other, respectively, to change the length of frame 14. In other words, rods 72 and 76 are telescopically and screw-threadedly connected.

Figure 6:
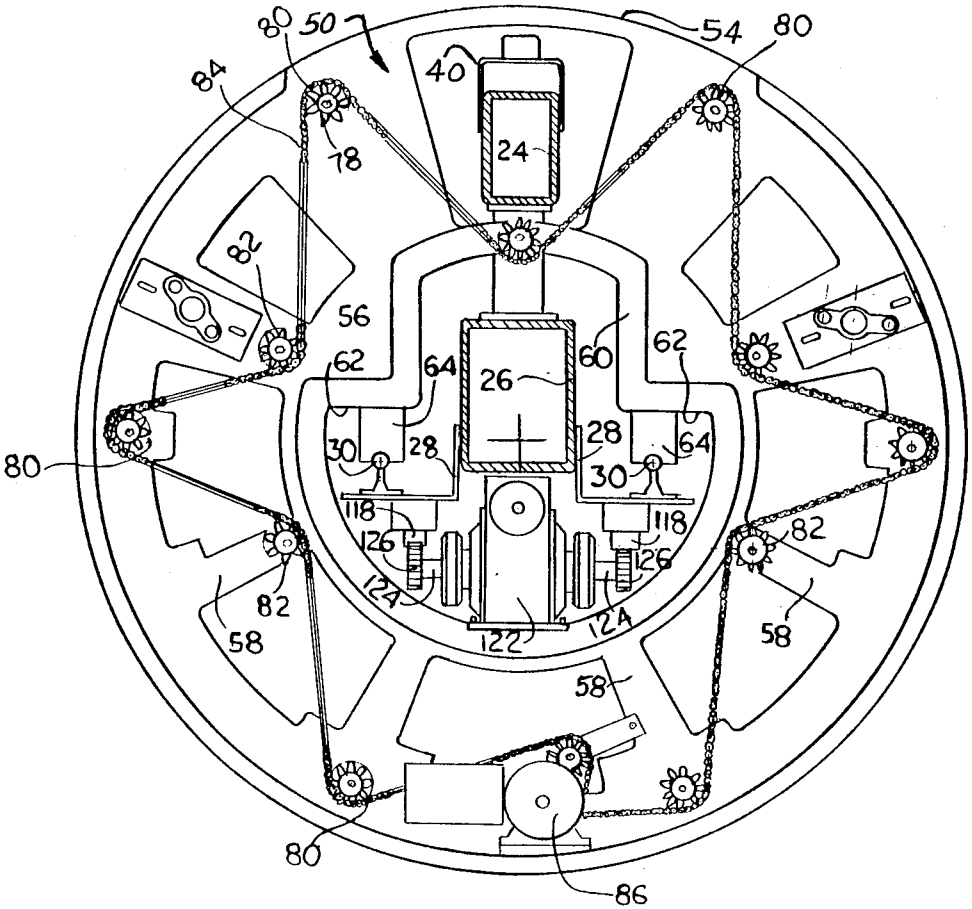
FIG. 6 is a cross-sectional view of the sewing machine of FIG. 1, taken along line 6—6 thereof.

As shown in FIGS. 6 and 10, each threaded rod 76 includes an extension shaft 78 extending through and to the outside of support casting 50. A gear 80 is secured to the end of each extension shaft 78. As illustrated in FIG. 6, gears 80 lie about a common circle having a common center lying on the axis of frame 14. A plurality of idler gears 82 are rotatably secured to the outer end face of support casting 50 and are inwardly spaced in the radial direction from gears 80. A chain 84 is wrapped about gears 80 and idler gears 82, and is driven by a drive motor 86. Thus, as drive motor 86 moves chain 84, gears 80 and threaded rods 78 are caused to rotate, thereby either lengthening or shortening frame 14.

Referring back to FIG. 10, a hollow, main drive rod 88 is rotatably journaled in support casting 52 through a suitable bearing assembly and extends toward support casting 50, but is spaced from inner ring 66. A hex bushing 90 is secured within main drive rod 88 at the distal or free end thereof. A hex rod 92 is rotatably mounted to support casting 50 by a suitable bearing assembly and extends through hex bushing 90. Thus, hex rod 92 is permitted to slide in the axially direction thereof with respect to main drive rod 88 but is rotatably fixed thereto.

A first drive gear 94 is secured to main drive rod 88 in meshing engagement with gear teeth 70 of inner ring 68. In like manner, a second drive gear 96 is secured about hex rod 92 in meshing engagement with gear teeth 70 of inner ring 66. As shown in FIGS. 7 and 8, a plurality of idler gears 98 are rotatably secured to the inner surface of castings 50 and 52 in meshing engagement with the gear teeth 70 of inner rings 66 and 68, respectively, whereby inner rings 66 and 68 are rotatably supported by castings 50 and 52, respectively. A plate 100 is preferably positioned over each idler gear 98, as shown, to prevent relative axial movement between gears 94,96 and 98 with respect to rings 66 and 68. In this regard, as main drive rod 88 is rotated, drive gears 94 and 96 are also rotated, thereby causing rotation of inner rings 66 and 68 about idler gears 98 with respect to castings 50 and 52, respectively.

As shown in FIGS. 1 and 8–10, a motor 102 is secured to the inner face of support casting 52 and has an output drive shaft 104 connected to a gear reducer 106. Gear reducer 106 includes an output drive shaft 108 extending to the outside of support casting 52 and including a gear 110 secured thereon. Gear 110 rotatably meshes with an idler gear 112 rotatably mounted on the outer surface of support casting 52, and idler gear 112 rotatably meshes with a gear 114 secured on main drive rod 88 extending to the outside of support casting 52. Thus, as output drive shaft 108 from gear reducer 106 rotates, main drive rod 88 is caused to rotate through gears 110, 112 and 114, thereby causing rotation of inner rings 66 and 68 with respect to support castings 50 and 52, respectively.

As shown in FIGS. 1 and 10, in order to provide increased stability to frame 14, a plurality of transverse connecting rods 116 interconnect main drive rod 88 and rods 72.

Figure 11:
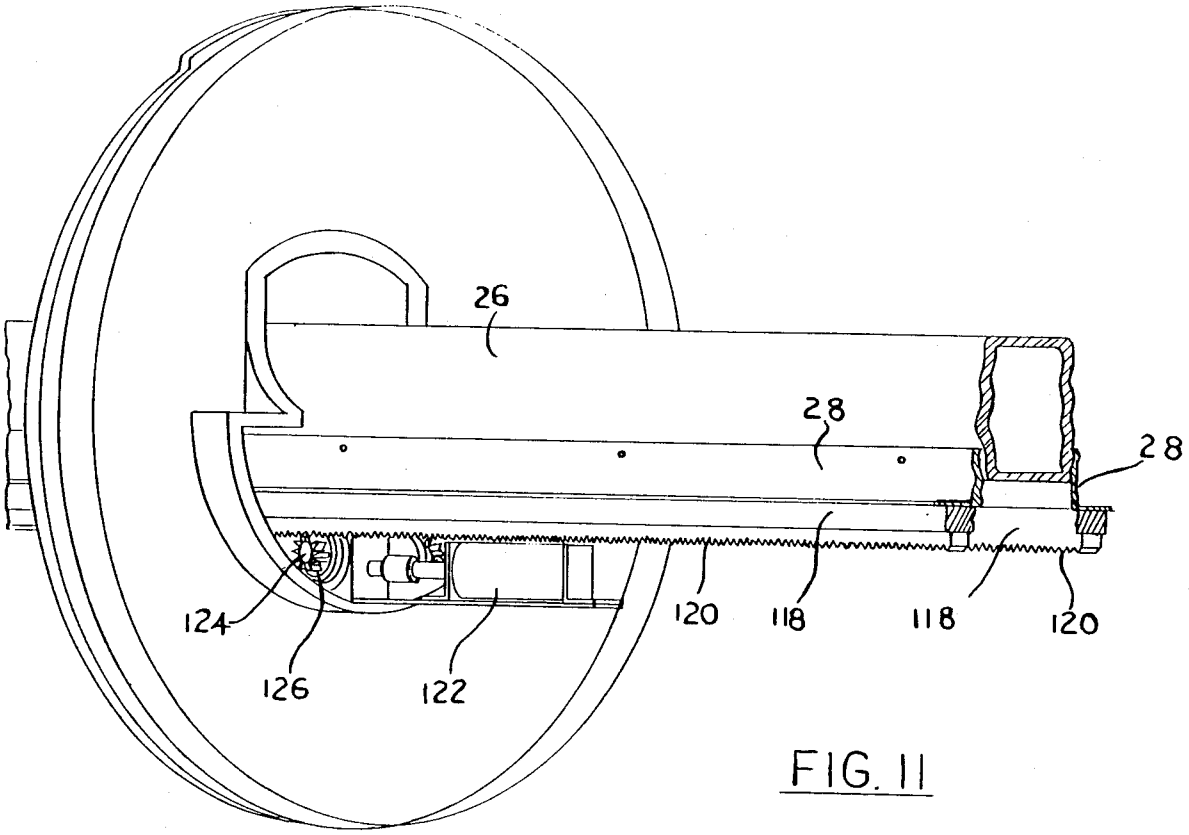
FIG. 11 is an enlarged perspective view of a portion of the sewing machine of FIG. 1, illustrating the rack and pinion arrangement for axially moving the frame along the base.

Referring now to FIGS. 6, 7 and 11, a mechanism for longitudinally driving frame 14 along base 12 will now be described. As shown, a rack 118 is secured to the underside of L-shaped brackets 28, each rack extending along the length of base 12 and having gear teeth 120 extending along the lower surface thereof. A linear drive motor 122 is mounted to support casting 50 and includes oppositely directed output drive shafts 124. A gear 126 is secured to the free end of each output drive shaft 124 in meshing engagement with gear teeth 120 of a respective rack 118, as shown. Thus, as output shafts 124 are rotated, gears 126 are caused to mesh with and move longitudinally with respect to racks 118 to thereby move frame 14 longitudinally along base 12.

With the arrangement thus far described, it is clear that inner rings 66 and 68 can rotate with respect to base 12, frame 14 can be moved longitudinally along base 12 and frame 14 can be either lengthened or shortened. Further, the rack and pinion assembly for longitudinally moving frame 14 along base 12 provides a novel arrangement according to the present invention.

As shown in FIGS. 2–5, frame 14 is preferably covered with a skin 128 of sheet metal or the like which, for example, can be secured to rods 72 by skin mounting spacers (not shown). In addition, left and right guards 130 and 132 can be placed over first and second end assemblies 44 and 46, respectively, to ensure that the internal mechanisms of frame 14 are protected.

Figure 12:
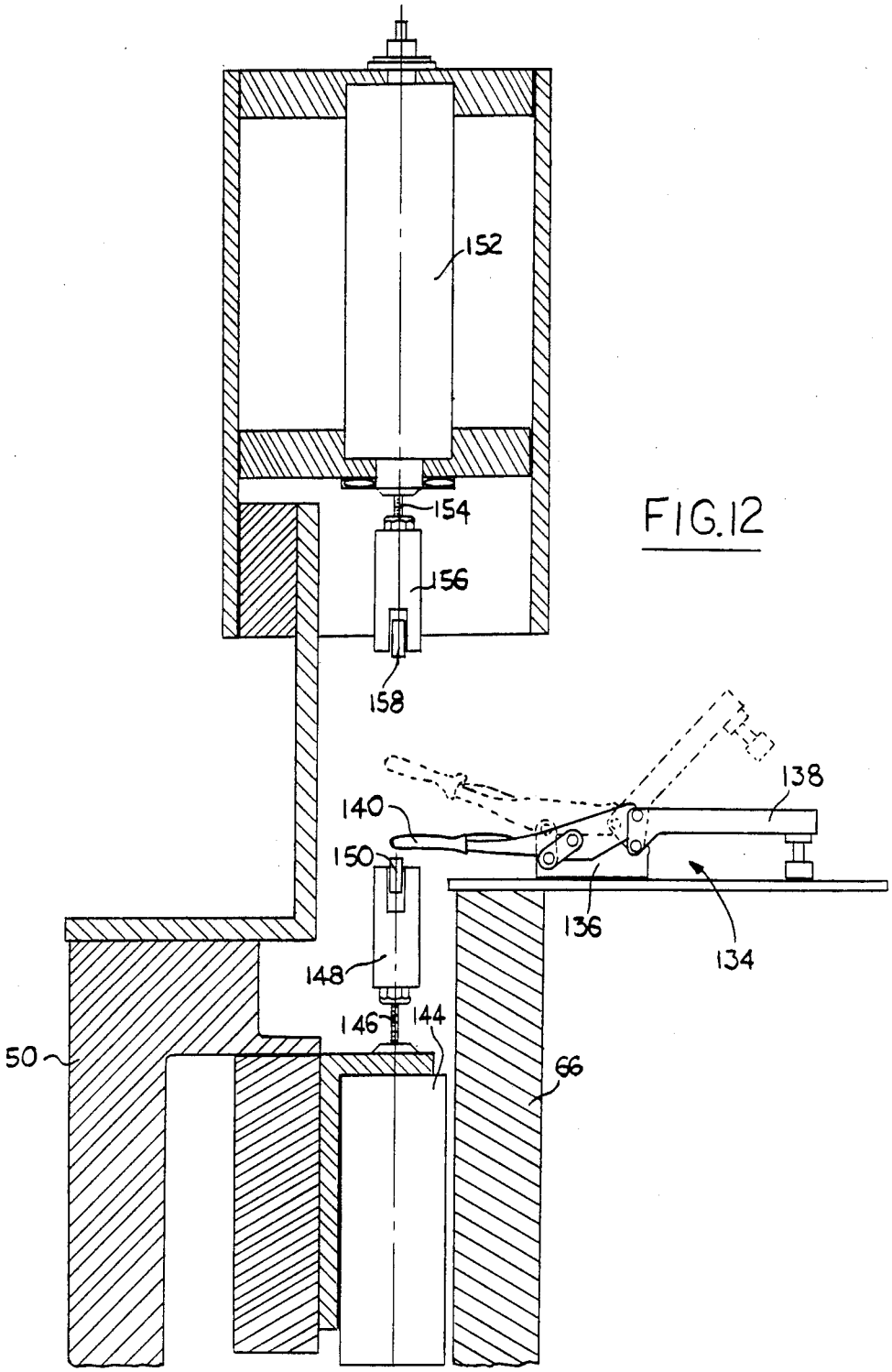
FIG. 12 is an enlarged cross-sectional view of a portion of the sewing machine of FIG. 1, illustrating the clamping assembly for clamping the fabric to the rings of the frame.

Referring now to FIG. 12, a clamping assembly for clamping the fabric to frame 14 will now be described. In FIG. 12, support casting 50 and inner ring 66 are shown schematically in order to better illustrate the clamping mechanism.

Specifically, a plurality of clamps 134, for example, sold by Lapeer Manufacturing Corp. of Lapeer, Michigan under Model No. KNU-VISE H-200 are mounted on the outer circumference of inner rings 66 and 68 and are thereby rotatable therewith. Each clamp 134 includes a base 136, a clamping arm 138 and an actuating arm 140, clamping arm 138 and actuating arm 140 being pivotally secured to base 136 such that clamping arm 138 clamps a fabric 142 to the outer circumference of the respective inner ring, as shown in solid lines, when actuating arm 140 is biased downwardly to the solid line position in FIG. 12. When actuating arm 140 is raised to the dashed line position in FIG. 12, clamping arm 138 is likewise raised to the dashed line position to release fabric 142.

In accordance with the present invention, a lower cylinder 144 is secured to the inner surface of each casting 50 and 52 in a space between the casting and its respective inner ring. Each lower cylinder 144 is positioned at the uppermost end of the support casting. A piston 146 is slidably received within lower cylinder 144 and includes a roller support block 148 at its free end, roller support block 148 rotatably supporting a roller 150 at the upper end thereof which is in alignment with the free end of actuating arm 140. In like manner, an upper cylinder 152 secured to each support casting and having a piston 154 extending downwardly therefrom above actuating arm 140, is provided. A roller support block 156 is secured to the free end of piston 154 and rotatably supports a roller 158 thereat. Pistons 146 and 154 may be actuated by any suitable means, but are preferably electrically operated in a solenoid type manner.

With the arrangement describe thus far, when piston 154 is moved downwardly in FIG. 12, roller 158 biases actuating arm to the said line position to clamp fabric 142 between the inner ring and clamping arm 138. When it is desired to release fabric 142, piston 146 is moved upwardly in FIG. 12 to bias actuating arm 140 to the dashed line position so as to release fabric 142.

A plurality of such clamps 134 are periodically spaced on the outer circumference of inner rings 66 and 68. Thus, to secure a fabric 142 about frame 14, the fabric is positioned thereon around inner rings 66 and 68 and the latter are rotated with respect to castings 50 and 52. During such rotation, piston 154 is periodically moved downwardly into engagement with each actuating arm 140 to move the same to the solid line position shown in FIG. 12 to clamp fabric 142 to frame 14. Since inner rings 66 and 68, and thereby actuating arms 140, are rotated, the use of rollers 158 does not hinder movement of the inner rings or damage the actuating arms 140. After fabric 142 has been clamped to frame 14, first and second end assemblies 44 and 46 can be moved outwardly with respect to each other to stretch fabric 142 on frame 14 to remove wrinkles and the like. Then, frame 14 can be moved longitudinally along base 12 and rings 66 and 68 can be rotated with respect to base 12, while stitching fabric 142 with sewing head 32, to provide a distinctive sewn pattern on fabric 142.

Figure 13:
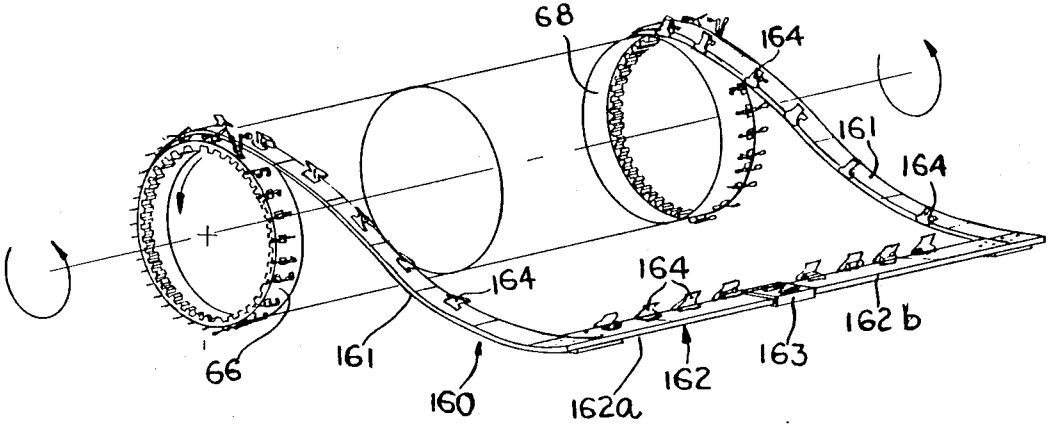
FIG. 13 is a perspective view of a flexible frame for securing the fabric to the substantially cylindrical frame.
Figure 14:
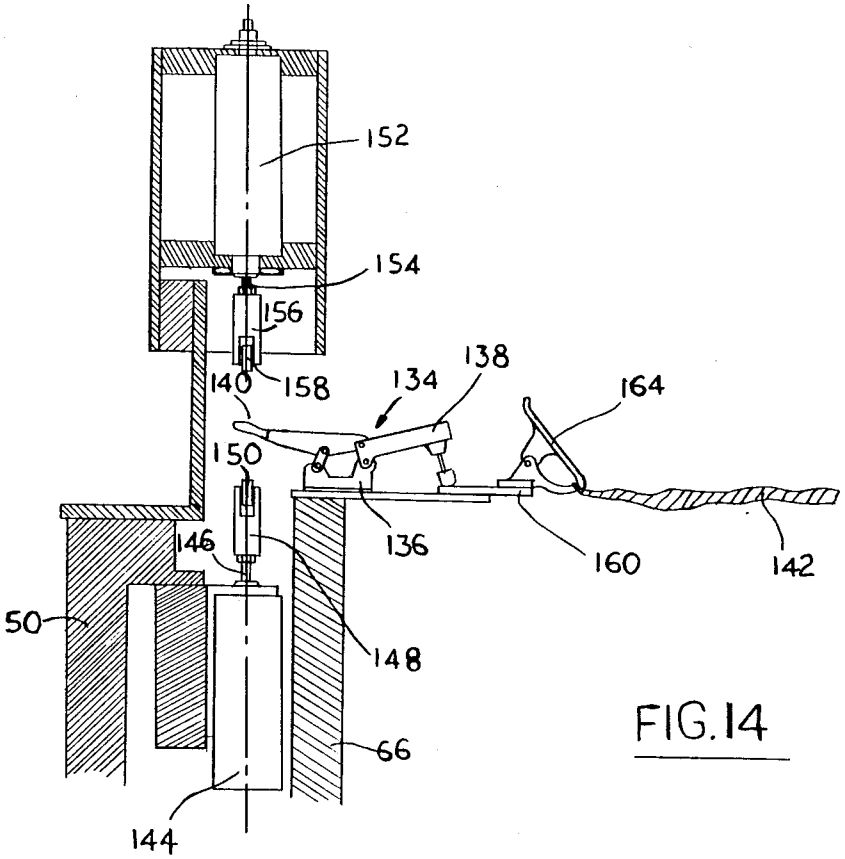
FIG. 14 is a cross-sectional view of a portion of the apparatus of FIG. 1, showing the clamping arrangement for securing the flexible frame of FIG. 13 to the substantially cylindrical frame.
Figure 15:
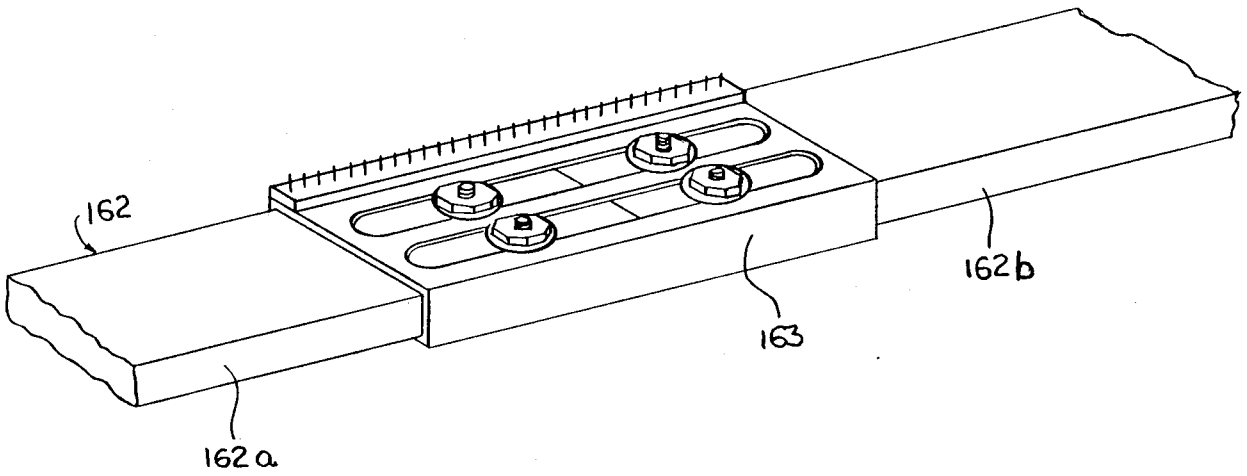
FIG. 15 is a perspective view of a portion of the flexible frame of FIG. 13.

Referring now to FIGS. 13–15, there is shown a slight modification of the clamping assembly of FIG. 12. Specifically, when using the embodiment of FIG. 12, there may be a relatively large amount of down time of the machine due to the necessity to carefully position fabric 142 thereon. In accordance with the embodiment of FIGS. 13 and 14, a flexible frame 160 is provided having flexible side members 161 and rigid steel cross members 162 at opposite ends thereof which are positioned in the longitudinal direction of frame 14. Each cross member 162 is formed by two sections 162*a* and 162*b* which can be telescopically slidable with respect to each other, and are secured together by an extension clamp 163 surrounding both sections 162*a* and 162*b*. Clamp 163 thereby permits adjustment of flexible frame 160 for the particular size of the quilt and to provide extra tension for the final set up.

A plurality of spring closed frame clamps 164 are secured to flexible side members 161 and rigid cross members 162 of flexible frame 160, and open inwardly of such frame. Thus, the fabric 142 is first secured to flexible frame 160 by means of frame clamps 164 without using quilting machine 10. Then, when fabric 142 is stretched between frame clamps 164, flexible frame 160 is positioned on the outer circumference of inner rings 66 and 68, and such flexible frame 160 is automatically clamped and rotated with inner rings 66 and 68, thereby greatly reducing the down time of quilting machine 10. Thus, flexible frame 160 enables handling of, for example, 144 inch goods around frame 14, with quick and easy mounting thereof. Further, since the goods can be framed while the machine is operating on another job, down time of the machine is substantially reduced.

Having described specific preferred embodiments of the invention with reference to the accompanying drawings, it will be appreciated that the present invention is not limited to those precise embodiments, and that various changes and modifications may be effected therein by one of ordinary skill in the art without departing from the scope or spirit of the invention as defined by the appended claims.

What is claimed is:

1. A quilting machine comprising:

(a) a base;

(b) a substantially cylindrically shaped frame slidably and rotatably mounted on said base, said frame including:

(i) a first end assembly;

(ii) a second end assembly;

(iii) each end assembly having a support member slidably mounted on said base and a ring rotatably mounted on the respective support member, each ring having a plurality of gear teeth spaced therearound;

(iv) said first and second end assemblies spaced from each other on said base;

(v) a plurality of first telescoping rods secured to said first end assembly and extending toward said second end assembly;

(vi) a plurality of second telescoping rods secured to said second end assembly and extending toward said first end assembly;

(vii) each first telescoping rod telescopically receiving a respective second telescoping rod;

(viii) at least one first telescoping rod screw-threadedly receiving at least one respective second telescoping rod;

(ix) at least one first and second telescoping rod rotatably fixed and axially movable with respect to each other; and (x) a gear on each of said first and second rotatably fixed and axially movable telescoping rods in mating engagement with said gear teeth of said rings;

(c) rotation means for rotating said rings with respect to said support members and including first rod rotation means for rotating said first and second rotatably fixed and axially movable telescoping rods;

(d) elongation means for changing the length of said frame, including second rod rotation means for rotating at least one screw-threaded rod; and (e) frame moving means for axially moving the frame along said base, said frame moving means including a rack having gear teeth mounted on said base, a gear rotatably mounted on said frame in meshing engagement with the teeth of said rack, and control means for controlling rotation of said gear to move said frame along said base.

2. A quilting machine according to claim 1; wherein said base includes first and second end supports and at least one bridge extending between said end supports; and said frame is slidably mounted on said at least one bridge.

3. A quilting machine according to claim 2; further comprising a shaft mounted on opposite sides of at least one bridge and at least two bearing assemblies secured to each support member for slidably mounting said support members on said shafts.

4. A quilting machine according to Claim 3; wherein said control means includes motor means for rotating said gear which is mounted on said frame, to move said frame along said shafts.

5. A quilting machine according to claim 2; wherein there are three bridges extending between said end supports.

6. A quilting machine according to claim 1; wherein each ring includes said plurality of gear teeth spaced along an inner circumference thereof; and further comprising means for rotatably mounting each said ring on a respective support member, said means for rotatably mounting including a plurality of gears rotatably secured to each support member in meshing engagement with the gear teeth of said respective rings.

7. A quilting machine according to claim 1; wherein said elongation means includes means for rotating a plurality of screw-threaded rods in synchronism with each other.

8. A quilting machine according to claim 7; wherein said means for rotating in synchronism includes a gear mounted to each threaded rod extending from one side of said frame, a chain drive wrapped about said gears and motor means for moving said chain drive.

9. A quilting machine comprising:

(a) a base;

(b) a substantially cylindrically shaped frame slidably and rotatably mounted on said base, said frame including:

(i) a first end assembly;

(ii) a second end assembly;

(iii) each end assembly having a support member slidably mounted on said base and a ring rotatably mounted on the respective support member, each ring having a plurality of gear teeth spaced therearound;

(iv) said first and second end assemblies spaced from each other on said base;

(v) a plurality of first telescoping rods secured to said first end assembly and extending toward said second end assembly;

(vi) a plurality of second telescoping rods secured to said second end assembly and extending toward said first end assembly;

(vii) each first telescoping rod telescopically receiving a respective second telescoping rod;

(viii) at least one first telescoping rod screw-threadedly receiving at least one respective second telescoping rod;

(ix) at least one first and second telescoping rod rotatably fixed and axially movable with respect to each other; and (x) a gear on each of said first and second rotatably fixed and axially movable telescoping rods in mating engagement with said gear teth of said rings;

(c) rotation means for rotating said rings with respect to said support members and including first rod rotation means for rotating said first and second rotatably fixed and axially movable telescoping rods;

(d) elongation means for changing the length of said frame, including second rod rotation means for rotating at least one screw-threaded rod;

(e) frame moving means for axially moving the frame along said base;

(f) a plurality of clamp means secured to the outer circumference of each ring for clamping fabric to said frame; and (g) clamp actuation means for controlling said plurality of clamp means to selectively clamp or unclamp said fabric with respect to said rings during rotation of said rings.

10. A quilting machine according to claim 9; wherein said clamp actuation means includes first piston-cylinder means for actuating each clamp means to clamp said fabric to said rings as each said clamp means travels thereby, and second piston-cylinder means for actuating each clamp means to release said fabric from said rings as each clamp means travels thereby.

11. A quilting machine according to claim 10; wherein each said clamping means includes an actuating arm, said first piston-cylinder means is positioned above said actuating arm for biasing the latter in a first direction as each said clamp means travels thereby, and said second piston-cylinder means is positioned beneath said actuation arm of each said clamp means as the latter travels thereby for biasing said actuating arm in a second, opposite direction.

12. A quilting machine according to Claim 11; wherein a roller is rotatably secured to the free end of each piston of said first and second piston-cylinder means.

13. A quilting machine comprising:

(a) a base;

(b) a substantially cylindrically shaped frame slidably and rotatably mounted on said base, said frame including:

(i) a first end assembly;

(ii) a second end assembly;

(iii) each end assembly having a support member slidably mounted on said base and a ring rotatably mounted on the respective support member, each ring having a plurality of gear teeth spaced therearound;

(iv) said first and second end assemblies spaced from each other on said base;

(v) a plurality of first telescoping rods secured to said first end assembly and extending toward said second end assembly;

(vi) a plurality of second telescoping rods secured to said second end assembly and extending toward said first end assembly;

(vii) each first telescoping rod telescopically receiving a respective second telescoping rod;

(viii) at least one first telescoping rod screw-threadedly receiving at least one respective second telescoping rod;

(ix) at least one first and second telescoping rod rotatably fixed and axially movable with respect to each other; and (x) a gear on each of said first and second rotatably fixed and axially movable telescoping rods in mating engagement with said gear teth of said rings;

(c) rotation means for rotating said rings with respect to said support members and including first rod rotation means for rotating said first and second rotatably fixed and axially movable telescoping rods;

(d) elongation means for changing the length of said frame, including second rod rotation means for rotating at least one screw-threaded rod;

(e) frame moving means for axially moving the frame along said base;

(f) flexible frame means having opposite flexible edges and a plurality of clamps spaced along said flexible edges for clamping a fabric therebetween;

(g) a plurality of clamp means secured to the outer circumference of each ring for clamping said flexible frame means to said frame; and (h) clamp actuation means for controlling said plurality of clamp means to selectively clamp or unclamp said flexible frame means with respect to said rings during rotation of said rings.

14. A quilting machine according to claim 13; wherein said clamp actuation means includes first piston-cylinder means for actuating each clamp means to clamp said flexible frame means to said rings as each said clamp means travels thereby, and second piston-cylinder means for actuating each clamp means to release said flexible frame means from said rings as each clamp means travels thereby.

15. A quilting machine according to claim 14; wherein each said clamping means includes an actuating arm, said first piston-cylinder means is positioned above said actuating arm for biasing the latter in a first direction as each said clamp means travels thereby, and said second piston-cylinder means is positioned beneath said actuation arm of each said clamp means as the latter travels thereby for biasing said actuating arm in a second, opposite direction.

16. A quilting machine according to claim 15; wherein a roller is rotatably secured to the free end of each piston of said first and second piston-cylinder means.

17. A quilting machine according to claim 13; wherein said flexible frame means is adjustable in width.

* * * * *